United States Patent [19]

Braddick

[11] Patent Number: 4,972,908

[45] Date of Patent: Nov. 27, 1990

[54] PACKER ARRANGEMENT

[75] Inventor: Britt O. Braddick, Houston, Tex.

[73] Assignee: Texas Iron Works, Inc., Houston, Tex.

[21] Appl. No.: 421,805

[22] Filed: Oct. 16, 1989

[51] Int. Cl.[5] ..... E21B 23/00; E21B 25/06

[52] U.S. Cl. ..... 166/387; 166/124; 166/125; 166/181; 166/208

[58] Field of Search ..... 166/387, 120, 124, 125, 166/153, 156, 155, 181, 182, 208, 291, 118

[56] References Cited

U.S. PATENT DOCUMENTS

| | | | |
|---|---|---|---|
| 3,545,542 | 12/1970 | Scott | 166/156 |
| 4,060,131 | 11/1977 | Kenneday et al. | 166/125 |
| 4,437,516 | 3/1984 | Cockrell | 166/120 |
| 4,479,544 | 10/1984 | Callihan et al. | 166/387 |
| 4,624,312 | 11/1986 | McMullin | 166/153 |
| 4,834,185 | 5/1989 | Braddick | 166/208 |
| 4,842,069 | 6/1989 | Baugh et al. | 166/291 |
| 4,848,459 | 7/1989 | Blackwell et al. | 166/387 |
| 4,854,386 | 8/1989 | Baker et al. | 166/181 |
| 4,862,966 | 9/1989 | Lindsey et al. | 166/387 |

*Primary Examiner*—Bruce M. Kisliuk
*Attorney, Agent, or Firm*—Jack W. Hayden

[57] ABSTRACT

An arrangement for lowering into a well bore casing on an operating string to sealably engage a packer that is supported on a tubular member so that the packer can be set either by a combination of hydraulic or mechanical action or mechanical action alone or hydraulic action alone includes a packer supported by a tubular member. An outer tubular member extends from adjacent the other end of the packer and telescopically receives the tubular member and a release mechanism releasably connects the tubular member and the outer tubular member with the operating string. A lock arrangement locks the tubular member and the outer tubular member together against relative longitudinal movement and the lock arrangement is operable after the release mechanism is actuated to disconnect the tubular member from the operating string whereupon said outer tubular member may be moved relative to the tubular member to expand the packer into sealing engagement with the casing.

23 Claims, 3 Drawing Sheets

PACKER ARRANGEMENT

STATEMENT OF THE PRIOR ART

Various types of packer arrangements for lowering into a well bore are provided so that the packer can be expanded into sealing engagement between a tubular member and a casing in the well bore. It is desirable to prevent setting or expanding the packer while it is being lowered into the well bore, or while manipulating the running string to conduct operations in the well bore. For example, where a liner is being cemented in a well bore, the running string and connected liner may be reciprocated or rotated during the cementing operation, and it is desirable to retain the packer in retracted, or unexpanded position while such reciprocation and/or rotation occurs.

In other situations it is desirable that the operating string which lowers the packer and other components into the well bore be released therefrom before other operations are conducted in the well to avoid problems that might arise if the operating string is left connected with the packer and other components. Particularly in setting and cementing a liner in a well bore it may be desirable to disconnect the operating string from the liner so that the setting string can be withdrawn from the liner by pulling straight up after the liner has been set on bottom in the well bore or hung on the casing so that if a malfunction occurs, the operating string may be readily retrieved from the liner and well bore to avoid leaving all or a substantial portion of the operating mechanism and operating string in the well bore which might require abandonment of the well bore or other problems. It is desirable to retain the packer in unexpanded position while cementing so that fluid in the well bore portion being cemented may be readily displaced. In some instances in the prior art, the packers have prematurely set between the tubular member or liner and casing before the cementing operation is started, or before the cementing is completed which interfere with obtaining a proper cement job.

SUMMARY OF THE INVENTION

The present invention provides a packer setting arrangement which can be used in a well bore for various operations, including but not limited to, cementing operations. The packer arrangement is lowered into a well bore on an operating string and includes a packer to sealably engage the packer in the well bore at a desired location. The arrangement is configured so that the packer is prevented from being set until other desired operations, such as by way of example only, cementing, is completed. The operating string can be released from the packer arrangement before or after the cementing operation, but the packer can be set only after the operating string is manipulated to release the packer anti-setting mechanism. The operating string may be readily removed from the well bore should some malfunction occur during the cementing operations conducted in the well bore, by releasing the operating string from the packer arrangement prior to the cementing operation.

Another object of the present invention is to provide a packer arrangement which includes a packer for lowering into a well bore casing on an operating string to sealably engage the packer that is supported on a tubular member with a casing wherein the packer can be actuated either by a combination of hydraulic and mechanical action or mechanical action alone or hydraulic action alone as conditions may warrant.

Another object of the present invention is to provide a packer arrangement which includes a packer for lowering into a well bore casing on an operating string to sealably engage the packer that is supported on a tubular member with a casing wherein the operating string may be released from the packer arrangement before or after the cementing operation, and wherein the operating string is released from the tubular member on which the packer is supported before the packer can be expanded into sealing position.

Another object of the present invention is to provide a packer arrangement which includes a packer for lowering into a well bore casing on an operating string to sealably engage the packer that is supported on a tubular member with a casing wherein the operating string may be released from the packer arrangement before or after the cementing operation, and wherein the operating string must be released from the tubular member on which the packer is supported before the packer can be expanded into sealing position and wherein the packer is selectively expanded into sealing position by either hydraulic action alone, mechanical action alone, or a combination of mechanical and hydraulic action.

Another object of the invention is to provide a packer arrangement including a packer supported adjacent one end on a tubular member with an outer tubular member extending from the other end of the packer which packer arrangement is releasably supported on a running string and a packer anti-setting mechanism to prevent premature expansion of the packer.

Other objects and advantages of the present invention will become readily apparent from a consideration of the following description and drawings.

DESCRIPTION OF THE PREFERRED EMBODIMENTS

The present invention will be described in its application and use with a liner in a well bore, but it can be appreciated that it is not limited to such specific application.

Figure 1:
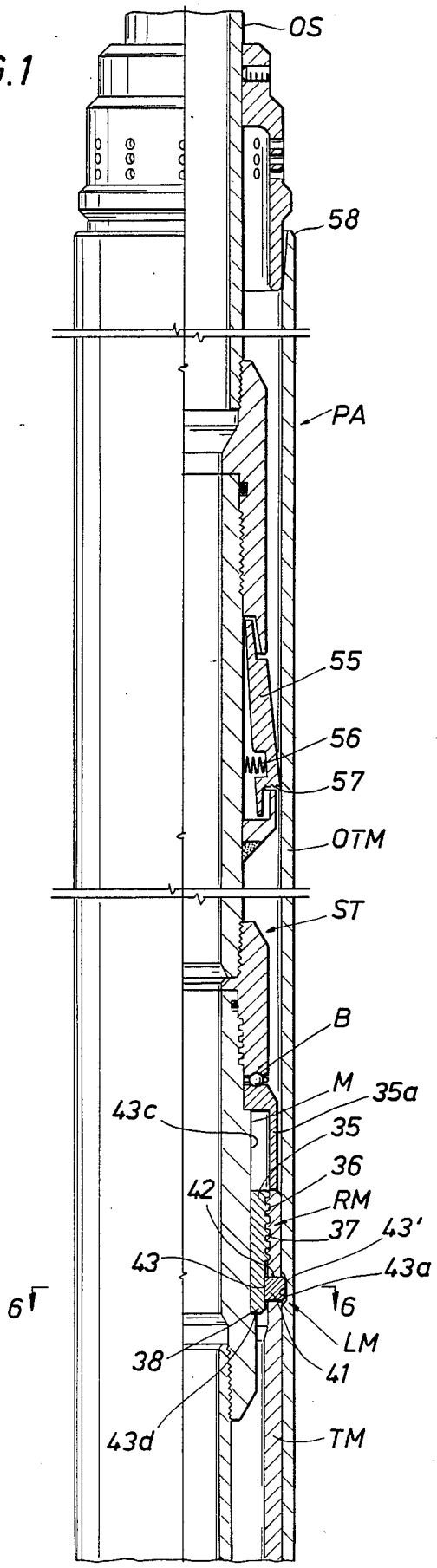
FIG. 1 is a one-quarter sectional view of one form of the packer arrangement of the present invention and illustrates an operating string that extends from the earth's surface into the well bore with a mechanical setting tool and liner or tubular member supported on the lower end thereof and surrounded by an outer tubular member. The operating string is secured to the liner or tubular member by release means, and when the release means is in the position illustrated in FIG. 1, lock means prevents premature expansion of the packer.
Figure 2:
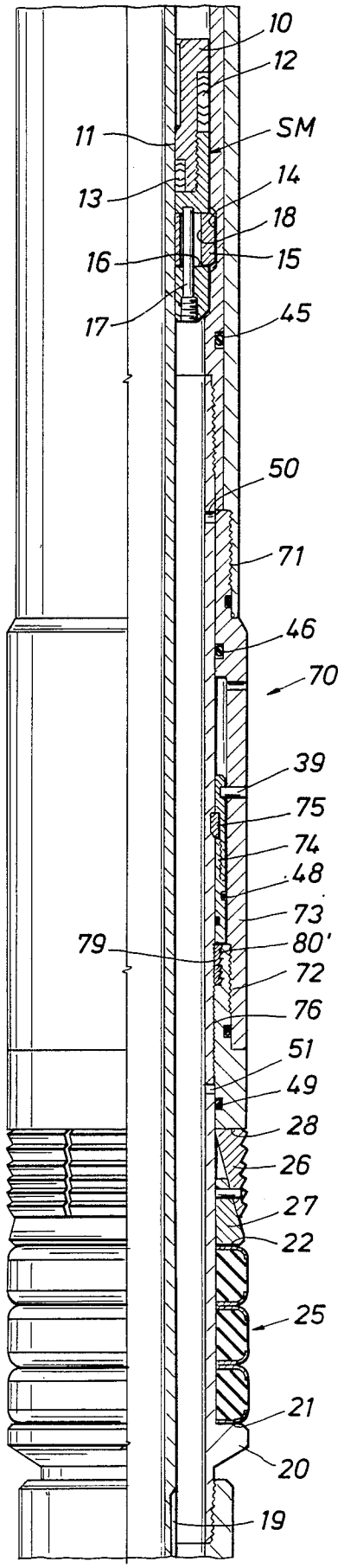
FIG. 2 is a continuation of the arrangement shown in FIG. 1 and illustrates that the liner or tubular member supports the packer thereon adjacent one end of the packer and the outer tubular member extends longitudinally from the other end of the packer.

Attention is first directed to FIG. 1 of the drawings wherein an operating string is designated by the letters OS. The operating string extends from the earth's surface into the well bore and includes a setting tool referred to generally at ST that extends into the liner or tubular member represented by the letters TM. The tubular member is in turn telescopically received in another or outer tubular member OTM as illustrated in the drawings. In FIG. 2 the tubular member TM is shown as provided with an annular shoulder 20 for receiving or supporting one end 21 of a compression set packer 25 which packer is of a form well known in the art. Another or outer tubular member OTM lower end 28 is supported adjacent the other end 22 of the packer 25 and in the embodiment illustrated in FIG. 2, slip segments 26 and cone means 27 extend between the lower end 28 of the outer tubular member and the end 22 of the packer to assist in securing the packer in expanded, sealing engagement with the casing C illustrated in dotted line in FIG. 4. In some situations it may be desirable to eliminate the slip segments 26 and cone means 27 in which event the end 28 of the outer tubular member is supported by the adjacent end 22 of the packer 25.

Suitable seal means represented at SM are illustrated in FIG. 2 for sealing between the operating string and the tubular member.

The seal means SM includes an annular body 10 with a bore 11 for receiving the operating string therethrough. Seal means 12 sealingly engage between the liner TM and the outer diameter of seal body 10. Seal means 13 sealingly engage between bore 11 and the outer diameter of operating string OS. An annular groove, or profile 14 in tubular member or liner TM is provided to receive dogs or lugs 15 that are slidably supported in circumferentially spaced openings 16 in body 10. A pin 17 extends through the openings 16 and through opening 18 in lugs 15 which opening is larger than the diameter or size of pins 17 to accommodate radial movement of lugs 15 into and out of the profile 14.

Before the operating string OS is lowered into the well bore the seal means are positioned on the operating string so lugs 15 engage in profile 14 to seal between the operating string OS and the liner or tubular member TM.

Also, the operating string OS is secured to the liner or tubular member TM and with the outer tubular member OTM by the release means RM and antisetting mechanism or lock means LM.

After positioning the liner on the casing by the hanger means or set on bottom; releasing the operating string from the liner and then cementing of the liner or tubular member TM in the well bore is completed, upward movement of the operating string OS positions the lugs 15 adjacent the reduced diameter portion 19 of the operating string, illustrated in FIG. 2, which permits the lugs 15 to move radially inward and withdraw from the profile so the seal means SM can be retrieved to the surface with the operating string OS.

When the packer arrangement represented generally by the letters PA is lowered into a well bore, the operating string and setting tool are connected with the tubular member TM by release means represented generally by the letters RM in FIG. 1 of the drawings and is connected with outer tubular member OTM by lock means LM as noted previously.

Figure 6:
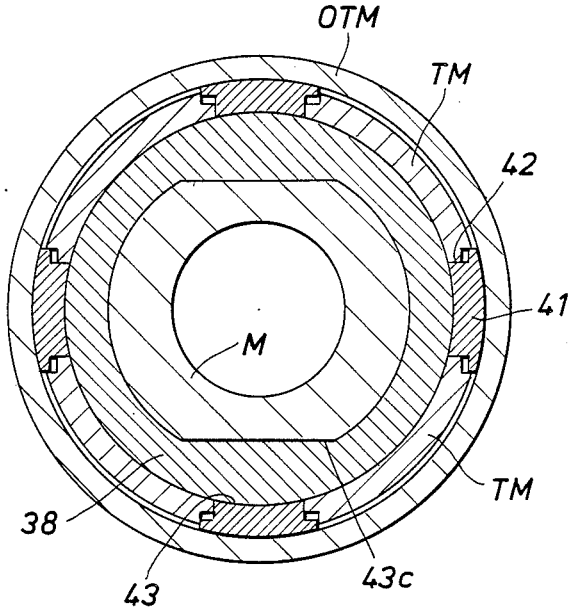
FIG. 6 is a sectional view on the line 6—6 of FIG. 1 to illustrate in greater detail an embodiment of the lock dogs.
Figure 7:
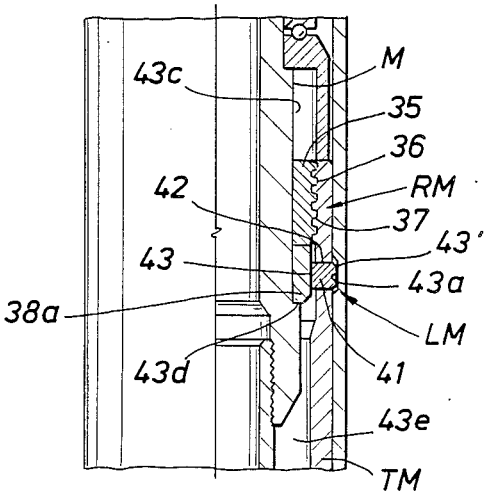
FIG. 7 is a partial one-quarter sectional view of an alternate form of the lock means to prevent premature actuation of the packer.

The release means comprises a setting nut 35 having external threads 36 thereon which threadedly engage internal threads 37 on the inner surface of the tubular member as shown in the drawings. The setting nut is movable longitudinally, but non-rotatably on the longitudinally extending non circular surface portion **43*c* of the mandrel M of the setting tool ST, as shown in FIGS. 1, 6 and 7, so that the setting nut and tubular member TM can be released from each other by relative rotation therebetween, which relative rotation is accommodated by bearing B as shown in FIG. 1. The relative rotation can be effected by rotating the operating string after the liner has been positioned in the well bore by hanger means which secure the liner to the casing or where the liner is positioned in the well bore by setting it on the bottom of the well bore, the operating string OS and setting tool ST may then be rotated to release from the tubular member. When the setting nut releases from the liner TM, it moves up into nut housing 35*a***.

Lock means represented generally by the letters LM include circumferentially spaced dogs or lugs 41 arranged in circumferentially spaced openings 42 in the tubular member TM as shown more clearly in FIGS. 1, 6 and 7 of the drawings which assist in preventing premature actuation or setting of the packer 25. The packer 25 is normally not set until after liner cementing operations are complete and in such event, it is desirable to prevent the packer from prematurely setting, which the present invention accomplishes. Thus, the operating string, liner TM and outer tubular member will remain as shown in FIG. 1 or FIG. 7 so that the lock means LM remain engaged.

The annular non-circular surface portion **43*c* on mandrel M adjacent nut 35 is recessed as shown to terminate in annular shoulder 43*d* at its lower end. A tubular extension 38 on nut 35 is supported adjacent or on the shoulder 43*d* when the external threads 36 of nut 35 are engaged with internal threads 37 on the liner or tubular member TM in the embodiment shown in FIG. 1**.

Figure 3:
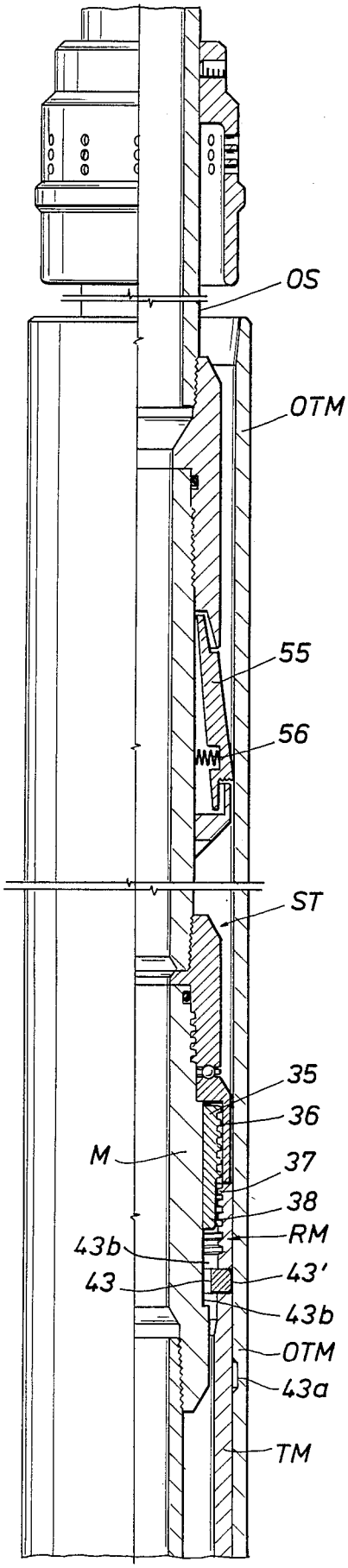
FIG. 3 is a one-quarter sectional view similar to FIG. 1 illustrating the release means actuated and the lock means released with the outer tubular member moved longitudinally to compress the packer into sealing engagement with the casing.

This relationship connects the operating string OS to the tubular member TM and outer tubular member OTM as shown in FIG. 1 since the inner ends 43 of dogs 41 abut the tubular extension 38 on the nut 35 and the outer ends 43' fit in groove **43*a* in the outer tubular member OTM so that the operating string, tubular member or liner and outer tubular member are all locked together against relative longitudinal movement. The outer tubular member OTM cannot move relative to the tubular member TM until the dogs 41 move out of groove 43*a*, as will be described. After the liner is hung on the casing, or set on bottom the nut 35 is unthreaded from the tubular member TM by rotating the operating string to release the operating string OS from the liner. The operating string OS can then be elevated to remove tubular extension 38 on nut 35 from contact with the inner end 43 of dogs 41 whereupon the dogs 41 are free to move out of groove 43*a* and inwardly into the recess 43*b* between the recessed portion portion 43*c* on mandrel M below tubular extension 38 on nut 35 and liner TM as shown in FIG. 3. When the outer tubular member OTM is then moved down by either hydraulic or mechanical force or by a combination of the hydraulic and mechanical forces, as will be described, shear pin 39 shears so that the packer 25** can be set, as will be explained.

FIG. 7 shows an alternate embodiment of the lock means LM, wherein a separate sleeve ring 38*a* is employed instead of the tubular extension 38 on nut 35. The sleeve 38*a* is seated on annular shoulder 43*d* and preferably abuts the lower end of nut 35 when the nut is connected with threads 36. As long as sleeve 38*a* remains on shoulder 43*d*, the packer 25 is locked against premature actuation. This relationship will be maintained until the operating string OS is raised to move ring 38*a* up and out of engagement with the inner ends 43 of dogs 41 and to position the operating string so that the dogs can move radially inward into the space 43*e*, as shown in FIG. 7, between the operating string and liner TM. The foregoing assures that the packer 25 can be maintained in unsealed relation with casing C so well bore fluid may be displaced properly around the unexpanded packer 25 as the cement is pumped into position in the well bore.

When it is desired to engage the packer with casing C, the outer tubular member is moved down by either mechanical or hydraulic force or by a combination of hydraulic and mechanical means to shear pin 39 and set packer 25 as will be described.

Figure 4:
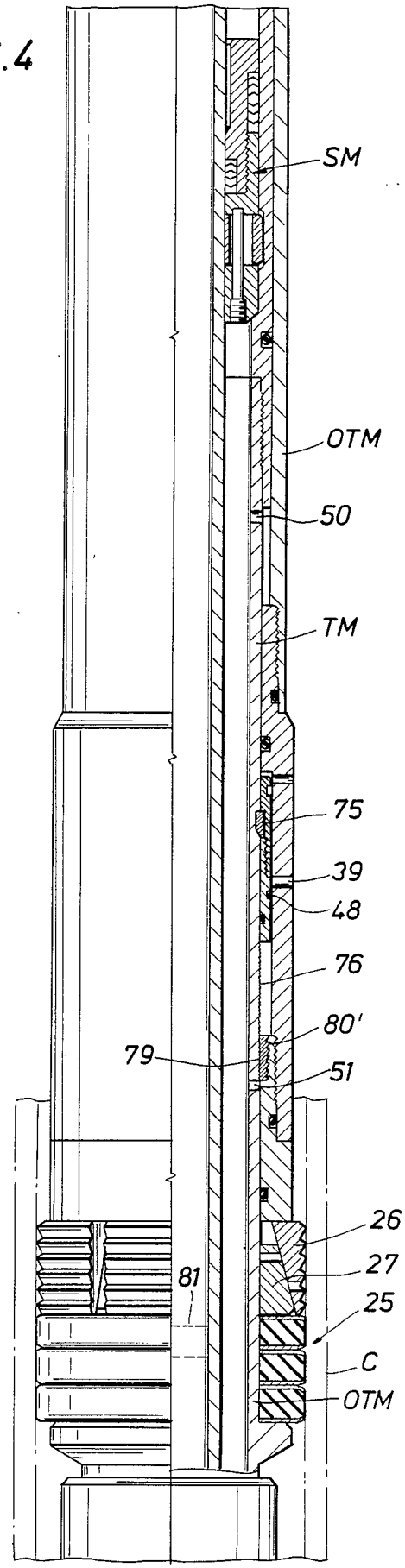
FIG. 4 is a continuation of FIG. 3 and shows the packer expanded to seal between the casing and liner or tubular member.

The liner or tubular member is to be secured in position on the casing C or set on bottom in the well bore to form an extension of the casing and it is generally desirable to cement the liner in place after it is either secured to the casing by hanger means of well known form or positioned on the bottom of the well bore.

Where hanger means are used to position the liner in the well bore, such hanger means are supported on the liner or tubular member which extends below the lower end portion shown in FIG. 4 in a manner well known in the art and may be either a mechanically actuated form or hydraulically actuated form of hanger means. Either form is well known as is its function and operation. Where hydraulic hanger means is employed, fluid pressure internally of the operating sting is used to secure the hanger and associated liner with the casing, and it is essential to retain the packer 25 in non-sealing relation with casing C, until the hanger, mechanical or hydraulic, has been actuated to hang or secure the liner, or tubular member TM on the casing C, as well as retaining the packer 25 unexpanded until the liner, or tubular member TM has been cemented in position in the well bore.

The liner or tubular member TM and outer tubular member OTM are provided with a first pair of spaced seals therebetween represented in FIG. 2 at 45 and 46 respectively as well as a second pair of longitudinally spaced seals therebetween represented at 48 and 49 with a first port means 50 in the tubular member TM between seals 45, 46 and a second port means 51 between the seal means 48, 49 respectively. Seal means SM seal off between diameters as are the pair of seals 48, 49 to thereby provide a differential diameter that is responsive to hydraulic pressure supplied through the tubular member port means 50 and 51 from the operating string lower open end within the tubular member for moving the outer tubular member OTM downwardly relative to the liner or tubular member TM to compress and set the packer 25.

If the packer arrangement is not used in cementing operations and it is desired to set the packer 25 by hydraulic pressure, any suitable seal means such as cups, or retrievable seal means SM is employed to seal off between the operating string and casing or pipe on one side of the packer arrangement, and a suitable seal or closure is provided on the other side of the packer arrangement between the operating string and casing or pipe so that hydraulic pressure is effective through the operating string to act on the seals as above described to expand the packer into sealing position in the casing or pipe.

Where the packer arrangement is employed in cementing operations, such as cementing a liner in a well bore, it is generally desired that the packer remain unset until the cementing operations are completed. In this situation, the shear pin 39 must be of sufficient strength to withstand the pressure required to displace the cement from the liner and strong enough to withstand the hydraulic pressure to actuate the wipers and plugs employed in the cementing operation, as will be described hereinafter. Shearing of pin 39 acts as responsive means to indicate that the liner has been released from the operating string and set on the casing, or set on the well bore bottom, which ever is desired.

Where the liner is set on the casing, this is indicated, or verified at the earth's surface by a change in weight on the operating string at the earth's surface if a mechanical liner hanger is employed, or when a hydraulically actuated liner hanger is employed, release and setting of the hanger is verified by a change in pump pressure at the earth's surface.

Also, either the nut 35 must remain connected to the liner TM as shown in FIG. 1 to prevent release of the lock means LM, or if it is desired to unlock the operating string from the nut prior to cementing, then the form shown in FIG. 7 is employed which permits nut 35 to be released while ring 38*a* maintains the lock means LM engaged.

Where the packer arrangement is employed with a liner as the tubular member, and it is desired to hang the liner in the casing with either a mechanical or a hydraulic hanger before cementing operations, either form of liner hanger is actuated in a manner well known in the art to secure the liner to the casing.

Figure 5:
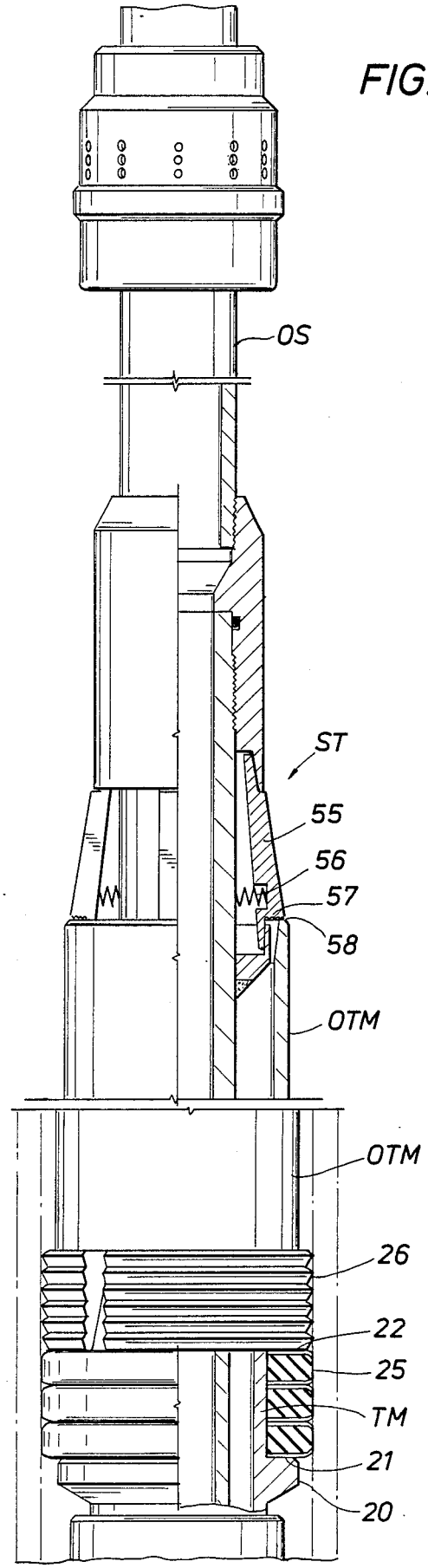
FIG. 5 illustrates the position of the operating string and setting tool so that the setting tool can be mechanically actuated to expand the packer into sealing engagement with the casing.

The retainer means 39 may be released mechanically by releasing the operating string from the liner after it is hung in the casing or set on bottom in the well bore and then positioning the dogs or lugs 55 on top of the outer tubular member as shown in FIG. 5 to urge it down to release the retainer means 39. If desired, a combination of hydraulic and mechanical force may be employed to release the retaining means 39.

Also the packer may be set by mechanical force alone by means of the dogs or lugs 55 mounted on the setting tool ST and extending longitudinally thereof which are urged by springs 56 normally outwardly, but are restrained from outward movement by engagement with the inner surface of the outer tubular member as shown. The operating string OS can be raised after nut 35 is disconnected from the liner or tubular TM to engage to lugs 55 with the outer tubular member OTM, as shown in FIG. 5, for urging it downwardly. The lugs 55 are provided with a lower recess to form a downwardly facing shoulder 57 as shown for engaging with a suitable surface such as upper end 58 of the outer tubular member for applying a force thereto by positioning the shoulders 57 on the surfaces 58 and setting down on the operating string to apply a mechanical force to the outer tubular member OTM to move it longitudinally and set the packer 25 as shown in FIG. 5.

This arrangement is more clearly illustrated in FIG. 5 of the drawings and shows the lugs 55 as having moved outwardly by means of the springs 56 after the operating string OS has been disconnected from the tubular member TM and moved upwardly to enable the lugs 55 to expand radially to seat or rest on the surface 58 for subsequent downward movement when weight is set down on the operating string to expand the packer 25 into sealing engagement with the casing C and to expand the slips 26 into securing arrangement or engagement with the casing C as shown in FIG. 5 of the drawings.

Where only a mechanically set form of packer arrangement is employed, that portion of the outer tubular member OTM represented generally by the numeral 70 in FIG. 2 may be removed or eliminated. In such event, the outer tubular member internal threads shown at 71, as shown in FIG. 2, would be connected directly to the tubular member external threads 72. This would eliminate the tubular portion 73 of the outer tubular member between the threads 71, 72 as well as the sleeve 74 and lock ring 75 which secures the sleeve 74 on the inner tubular member. Also, suitable seals would be provided adjacent the threaded connection 71, 72 and port means 50,51 in the liner or tubular member TM would be eliminated.

Additional means are provided to assist in retaining the packer 25 expanded include the serrated external annular surface 76 on the tubular member TM which engages with the internal serrated surface 79 on ring 80' threadedly secured on the outer tubular member as shown in FIG. 2 of the drawings. As can be seen in FIG. 4 when the outer tubular member is moved longitudinally, the ring 80' is moved downwardly and the threads 79 and 80' are configured to accommodate such longitudinal movement but restrain movement of the outer tubular member relative to the tubular member in an opposite direction.

OPERATION OF THE INVENTION

The present invention is lowered into the well bore by suitable means well known in the art, and the release means RM and lock LM including shear pins 39 prevent setting of the packer 25. In normal operations with a liner, the liner or tubular member TM is first hung or connected to the casing in a manner well known in the art, and then the liner cemented in a well bore in a manner well known in the art or set on bottom in the well bore.

After the cementing is completed the packer 25 may then be expanded by either the hydraulic arrangement or by employing mechanical force or by a combination of mechanical and hydraulic forces as previously described herein. Hydraulic pressure may be applied through the operating string OS to the port means 50, 51 to move the outer tubular member OTM downwardly to expand the packer 25 into sealing engagement with the casing C to seal between the casing C and the liner or tubular member TM. Since, the operating string has been released from the liner or tubular member TM, it can be manipulated to position the lugs 55 on the upper end of the outer tubular member as shown in FIG. 5 and apply a force to the lugs 55 and outer tubular member in the manner previously described. If desired, the packer 25 may be set mechanically, or it may be set hydraulically, or it may be set by a combination of hydraulic and mechanical action. It is preferred to maintain the packer 25 in unexpanded position as represented in FIG. 2 until the cementing has been completed so that fluid in the well bore can be displaced as the cement is discharged thereinto. The operating string OS can then be removed from the well bore by pulling up on it to retrieve the seal means SM with the operating string.

The foregoing disclosure and description of the invention are illustrative and explanatory thereof, and various changes in size, shape and materials as well as in the details of the illustrated construction may be made without departing from the spirit of the invention.

What is claimed is:

1. A packer arrangement including a packer for lowering into a well bore casing on an operating string to expand the packer into sealing position in the well bore including:

a tubular member extending through the packer and supporting the packer adjacent one end of the packer;

another tubular member telescopically receiving said tubular member and extending from adjacent the other end of the packer to terminate in longitudinally spaced relation to said tubular member;

slip means between the end of said another tubular member and the packer and responsive to movement of said another tubular member to secure with the casing when said packer is expanded into engagement with the casing;

release means releasably connecting said tubular member with the operating string said release means including internal threads on said tubular member, nut means slidably but nonrotatably mounted on the operating string, said nut means having external threads thereon engageable with said internal threads to releasably secure the operating string and tubular member together; and means to prevent expansion of the packer into sealing position, said means to prevent expansion of the packer into sealing position including lock means to lock said tubular members against relative longitudinal movement.

2. The packer arrangement of claim 1 including bearing means associated with the operating string and tubular member to accommodate relative rotation therebetween.

3. The packer arrangement of claim 1 including retrievable seal means between the operating string and said tubular member to accommodate axial movement of the operating string relative to the tubular member while avoiding communication between the inside and outside of the tubular member throughout the length of the tubular member below said retrievable seal means and above where the tubular member may communicate with the well bore.

4. The packer arrangement of claim 1 wherein said lock means includes an annular recess internally of said another tubular member, circumferentially spaced lug means slidably mounted in openings in said tubular member for engaging in said annular recess and surface means on said nut means abutting said lug means when said release means connects said tubular member with the operating string.

5. The packer arrangement of claim 4 wherein said lock means further includes annular shoulder means on the operating string, an annular member seated on said shoulder below said nut and abutting said lug means.

6. The packer arrangement of claim 1 wherein said lock means and said release means include cooperating surface means to prevent said lock means from unlocking until after said release means is actuated to disconnect said tubular member from the operating string.

7. The packer arrangement of claim 1 wherein said means for moving said another tubular member includes seal means sealing between said tubular member and said another tubular member and port means in said tubular member for conducting fluid pressure from the operating string to act on said seal means to move said another member relative to said tubular member to expand said packer.

8. The packer arrangement of claim 1 wherein said means for moving includes surface means on the operating string and said another tubular member co-engageable whereby manipulation of the operating string moves said outer tubular member to expand said packer.

9. The packer arrangement of claim 8 wherein said surface means on the operating string includes members mounted on the operating string, spring means normally urging said members outwardly of the operating string so that after said release means is actuated to release the operating string from said tubular member, the operating string may be manipulated to withdraw it relative to said another tubular member whereupon said members may project radially relative to the operating string and engage an annular surface on said another tubular member to move said another tubular member longitudinally to expand said packer by manipulating the operating string.

10. The packer arrangement of claim 1 wherein said means for moving said another tubular member includes mechanically responsive means and hydraulically responsive means for jointly moving said another tubular member to expand said packer.

11. The packer arrangement of claim 1 including shear means releasably connecting said tubular member and said another tubular member together.

12. An arrangement for lowering into a well bore casing on an operating string to sealably engage a packer that is supported on a tubular member, said arrangement including means to set said packer by a combination of hydraulic means and mechanical means or by said mechanical means alone or said hydraulic means alone, said arrangement including:

a compression packer;

a tubular member supporting said packer adjacent one end thereof;

an outer tubular member telescopically receiving said tubular member and extending from adjacent the other end of said packer to terminate in longitudinal spaced relation to said tubular member;

release means including an externally threaded nut slidably and non-rotatably supported on the operating string and threads on said tubular member for engaging said externally threaded nut to releasably secure said tubular member to the operating string, said tubular member releasable from the operating string by rotation of the operating string to unthread said threaded nut from said tubular member;

said tubular member having circumferentially spaced openings therein;

a lock to releasably lock said tubular member and outer tubular member to the operating string, said lock including:

dogs releasably positioned in said openings;

an internal annular groove on said outer tubular member for receiving one end of said dogs;

a surface associated with said nut for abutting the other end of said dogs to maintain said dogs in said groove to lock said tubular member, outer tubular member and the operating string together to release said outer tubular member from said tubular member and operating string when said dogs are withdrawn from said groove; and shear means to secure said tubular member and outer tubular member together;

spaced seal means between said tubular member and outer tubular member providing fluid responsive differential surfaces between said tubular member and outer tubular member;

port means between said spaced seal means for conducting fluid pressure from the operating string to act on said fluid responsive differential surfaces and move said outer tubular member longitudinally to compress said packer and seal with the casing after said tubular member is released from the operating string; and cooperating surfaces on the operating string and said outer tubular member engageable for moving said outer tubular member and expand said packer into said sealing engagement with the casing after said outer tubular member is released from the operating string.

13. The arrangement of claim 12 wherein said spaced seal means includes a first and second pair of upper and lower spaced seals wherein the upper seal of each pair between said inner and outer tubular members is on a larger diameter than the lower seal, and wherein said port means includes spaced upper and lower ports in the operating string for communicating fluid from the operating string between said upper and lower pairs of seals, respectively.

14. The arrangement of claim 12 wherein the surface associated with said nut is on said nut.

15. The arrangement of claim 12 wherein the surface associated with said nut is member supported on the operating string adjacent said nut.

16. The arrangement of claim 12 including seal means between said tubular member and the operating string spaced from one side of said packer; and closure means spaced from the other side of said packer whereby fluid pressure from the operating string may be transmitted to said spaced seal means.

17. An arrangement for lowering into a well bore casing on an operating string to sealably engage a packer that is supported on a tubular member, comprising:

a compression packer;

a tubular member supporting said packer adjacent one end thereof;

an outer tubular member extending from adjacent the other end of said packer and telescopically receiving said tubular member;

release means including an externally threaded nut slidably and non-rotatably supported on the operating string and threads on said tubular member for engaging said externally threaded nut to releasably secure said tubular member to the operating string, said tubular member releasable from the operating string by rotation of the operating string to unthread said threaded nut from said tubular member;

said tubular member having circumferentially spaced openings therein;

a lock to releasably lock said tubular member and outer tubular member to the operating string, said lock including:

dogs releasably positioned in said openings;

an internal annular groove on said outer tubular member for receiving one end of said dogs;

a surface associated with said nut for abutting the other end of said dogs to maintain said dogs in said groove to lock said tubular member, outer tubular member and the operating string together to release said outer tubular member from said tubular member and operating string when said dogs are withdrawn from said groove; and shear means to secure said tubular member and outer tubular member together;

spaced seal means between said tubular member and outer tubular member providing fluid responsive differential surfaces between said tubular member and outer tubular member;

port means between said spaced seal means for conducting fluid pressure from the operating string to act on said fluid responsive differential surfaces and move said outer tubular member longitudinally to compress said packer and seal with the casing after said tubular member is released from the operating string; and cooperating surfaces on the operating string and said outer tubular member engageable for moving said outer tubular member and expand said packer into said sealing engagement with the casing after said outer tubular member is released from the operating string.

18. An arrangement for lowering into a well bore casing on an operating string to sealably engage a packer that is supported on a tubular member, comprising:

a compression packer;

a tubular member supporting said packer adjacent one end thereof;

an outer tubular member extending from adjacent the other end of said packer and telescopically receiving said tubular member;

release means including an externally threaded nut slidably and non-rotatably supported on the operating string and threads on said tubular member for engaging said externally threaded nut to releasably secure said tubular member to the operating string, said tubular member releasable from the operating string by rotation of the operating string to unthread said threaded nut from said tubular member;

said tubular member having circumferentially spaced openings therein;

a lock to releasably lock said tubular member and outer tubular member to the operating string, said lock including:

dogs releasably positioned in said openings;

an internal annular groove on said outer tubular member for receiving one end of said dogs;

a surface associated with said nut for abutting the other end of said dogs to maintain said dogs in said groove to lock said tubular member, outer tubular member and the operating string together to release said outer tubular member from said tubular member and operating string when said dogs are withdrawn from said groove; and shear means to secure said tubular member and outer tubular member together;

spaced seal means between said tubular member and outer tubular member providing fluid responsive differential surfaces between said tubular member and outer tubular member;

port means between said spaced seal means for conducting fluid pressure from the operating string to act on said fluid responsive differential surfaces and move said outer tubular member longitudinally to compress said packer and seal with the casing after said tubular member is released from the operating string; and manipulating the operating string to disconnect the outer tubular member from the tubular member.

19. A method of positioning a packer arrangement with a packer thereon in a well bore casing on an operating string to sealably engage the packer in the well bore casing including the steps of:

seating one end of the packer around a tubular member;

telescopically positioning the tubular member and an outer tubular member so that one end of said outer tubular member is adjacent the other end of the packer;

releasably connecting the tubular member with the operating string;

locking the operating string, tubular member and said outer tubular member together against relative longitudinal movement;

lowering the operating string, tubular member and said outer tubular member into well bore casing;

manipulating the operating string to disconnect it from the tubular member and to unlock the tubular member from said outer tubular member; and expanding the packer into sealing engagement with the casing by applying fluid pressure internally of the operating string to move the outer tubular member longitudinally after it has been unlocked from the tubular member.

20. The method of claim 19 wherein the packer is expanded by manipulating the operating string to engage the operating string and outer tubular member for applying a compressive force to the outer tubular member while the fluid pressure is applied to move the outer tubular member longitudinally to expand the packer into sealing engagement with the casing.

21. The method of claims 19 or 20 including the step of sealing off between the operating string and tubular member and between the operating string and casing in the well bore prior to applying fluid pressure.

22. An arrangement for lowering into a well bore casing on an operating string to sealably engage a packer that is supported on the tubular member, said arrangement including:

a compression packer;

a tubular member supporting said packer adjacent one end thereof;

an outer tubular member extending from adjacent the other end of said packer and telescopically receiving said tubular member;

releasable means to releasably secure said tubular member to the operating string;

lock means to releasably lock said tubular member and outer tubular member to the operating string;

spaced seal means between said tubular member and outer tubular member providing fluid responsive differential surfaces between said tubular member and outer tubular member; and port means between said spaced seal means for conducting fluid pressure from the operating string to act on said fluid responsive differential surfaces and move said outer tubular member longitudinally after said lock means has released said tubular member from said outer tubular member to compress said packer and seal with the casing.

23. An arrangement for lowering into a well bore casing on an operating string to sealably engage a packer that is supported on the tubular member, said arrangement including:

a compression packer;

a tubular member supporting said packer adjacent one end thereof;

an outer tubular member extending from adjacent the other end of said packer and telescopically receiving said tubular member;

releasable means to releasably secure said tubular member to the operating string;

lock means to releasably lock said tubular member and outer tubular member to the operating string; and cooperating surfaces on the operating string and said outer tubular member engageable for moving said outer tubular member after said lock means has released said tubular and outer tubular member from the operating string for moving said outer tubular member and expanding said packer into sealing engagement with the casing.

* * * * *